US008241086B2

(12) United States Patent
Kim

(10) Patent No.: US 8,241,086 B2
(45) Date of Patent: Aug. 14, 2012

(54) STUFFED TOY FILLED WITH SUPER ABSORBENT POLYMER

(75) Inventor: Jin Sung Kim, Seongnam-si (KR)

(73) Assignee: Jin Seung Kim (KR)

( * ) Notice: Subject to any disclaimer, the term of this patent is extended or adjusted under 35 U.S.C. 154(b) by 265 days.

(21) Appl. No.: 12/456,589

(22) Filed: Jun. 16, 2009

(65) Prior Publication Data

US 2010/0003890 A1 Jan. 7, 2010

(30) Foreign Application Priority Data

Jun. 17, 2008 (KR) ..... 20-2008-0008084 U

(51) Int. Cl.
*A63H 3/02* (2006.01)

(52) U.S. Cl. ..... 446/369

(58) Field of Classification Search ..... 446/369; 473/594

See application file for complete search history.

(56) References Cited

U.S. PATENT DOCUMENTS

| | | | | |
|---|---|---|---|---|
| 4,795,762 | A | 1/1989 | Diamantoglou et al. | |
| 5,496,890 | A | 3/1996 | Sackmann et al. | |
| 5,567,779 | A | 10/1996 | Sackmann et al. | |
| 5,731,365 | A | 3/1998 | Engelhardt et al. | |
| 6,409,569 | B1 * | 6/2002 | Boone | 446/74 |
| 6,503,582 | B1 | 1/2003 | Nardoza et al. | |
| 7,144,957 | B2 | 12/2006 | Funk et al. | |
| 7,347,988 | B2 | 3/2008 | Hu et al. | |
| 7,393,908 | B2 | 7/2008 | Heide et al. | |
| 7,422,507 | B2 | 9/2008 | Chernick et al. | |
| 7,559,862 | B2 * | 7/2009 | Von Heland | 473/594 |
| 7,815,878 | B1 * | 10/2010 | Wheatley | 422/306 |
| 2004/0265387 | A1 | 12/2004 | Hermeling et al. | |
| 2007/0254555 | A1 * | 11/2007 | Johnson et al. | 446/369 |
| 2008/0009220 | A1 * | 1/2008 | Simpson et al. | 446/175 |
| 2008/0125004 | A1 | 5/2008 | Tsai | |

* cited by examiner

*Primary Examiner* — Michael Dennis
(74) *Attorney, Agent, or Firm* — Tope-McKay & Associates; Marcus Risso

(57) ABSTRACT

The present design is related to stuffed toys formed in the shapes of various dolls or animals by using a bead-shaped super absorbent polymer as filler instead of cotton or packing in the stuffed toys, with the stuffed toys having variable states of contraction and expansion according to liquid absorption amount, without the leakage of the super absorbent polymer itself. The stuffed toy is characterized by having been stitched in the shape according to the stuffed toy with a water absorbent inner fabric on the inside of water absorbent outer fabric. The shape is formed by the bead-shaped super absorbent polymer that expands when water is absorbed to fill the inner space. The outer fabric and the inner fabric are water absorbent with the inner fabric being made of bead-proof material such that the stitching is made up of fine density that does not allow leakage of the beads.

8 Claims, 5 Drawing Sheets

1

STUFFED TOY FILLED WITH SUPER ABSORBENT POLYMER

PRIORITY CLAIM

The present application is a United States Non-Provisional Utility Patent Application claiming the benefit of priority of Korean Patent Application No. 20-2008-0008084, filed on Jun. 17, 2008, entitled, "Stuffed Toy Filled with Super Absorbent Polymer."

BACKGROUND OF THE INVENTION (1) Field of Invention

The present invention relates to stuffed toys and, more specifically, to stuffed toys formed in the shapes of various dolls or animals that are filled with a bead-shaped super absorbent polymer having variable states of contraction and expansion according to liquid absorption, without the leakage of the super absorbent polymer itself.

(2) Description of Related Art

As is well known, stuffed toys to make shapes of various dolls and animals by filling in the appropriate materials inside the space after a specific form has been stitched on the fabric (cloth) is done by employing the method of cutting and sewing together the model and then turning inside to fill the inside with materials, such as cotton, and finally sewing up the opening.

Stuffed toys are one of the representatives of traditional toys that have been enjoyed and loved for many reasons, such as the softness of the cloth they are made of, safeness from injuries, and the fact that they can be made utilizing surplus cloth and packing (cotton).

The limitation of stuffed toys, since they are still and do not change from the original form, is that they are low in the function of creating curiosity. In order to supplement these limitations, stuffed toys with electronic devices including sensors and audio devices to give changes with sounds or movements are being widely introduced.

Another limitation of stuffed toys is the fact that they are not suitable to play with in the water since all materials they are made with are cloth and cotton and therefore become soggy and do not dry well once water is absorbed.

Thus, a continuing need exists for a stuffed toy that is suitable to play with in water and that can change from its original form.

SUMMARY OF INVENTION

The object of the present design is to provide stuffed toys that change by contraction and expansion according the water absorption amount (absorption and evaporation) of the super absorbent polymers without leakage by filling with bead-shaped super absorbent polymers instead of cotton or packing in stuffed toys that have the form of various dolls and animals.

Stuffed toys with super absorbent polymers are provided from the following design. Stuffed toys filled with super absorbent polymers in accordance with the present design are formed by stitching in water penetrating/absorbent inner fabric to the inside of the outer cover that is water penetrating/absorbent used as a typical outer covering of the stuffed toys, and by filling with super absorbent polymers in said inner space with bead shapes when water is absorbed in the inner space created by said outer fabric and said inner fabric.

Said outer fabric and the inner fabric are water penetrable and at least said inner fabric is made of bead-proof material to prevent said beads from penetrating, and said stitching is made at fine density without any leakage of said beads.

Desirably, said inner fabric is high-density fabric that has a minimum thickness of 20×20 in thread count and maximum thickness 60×60.

Desirably, said stitching is fine density stitching of 70 stitches per inch.

Desirably, the diameter of said bead-shaped super absorbent polymer before expansion is 0.1-1 mm average with filling of 1.2 to 10 water weight capacity.

Desirably, at least one of the additives of deodorant and disinfectant is introduced.

Desirably, said bead-shaped super absorbent polymer is put into capsules that are easily dissolved by water and then filled.

Stuffed toys filled with super absorbent polymer have the following effects. First, positional changes with the expansion and contraction plus other changes in forms in stuffed toys can be enjoyed according to the water absorption amount of the bead-shaped super absorbent polymer since the stuffed toys in the present design employ bead-shaped super absorbent polymers instead of cotton or packing for a filler. Second, according to the present design, the outer fabric is made of the normal water penetrable sewing fabric widely used in stuffed toys and by filling in the inner fabric that is bead-proof while water penetrable on the inside of the outer fabric, as well as by applying super absorbent polymer that has been selected for the filler, the water freely penetrates between outer and inner fabrics while leakage is prevented, this has resulted in providing the super absorbent polymers to be used as a filler for stuffed toys.

Third, stuffed toys in the present design have the outer and inner fabrics made of cloth and are designed to be used in the water, the surface of stuffed toys do not have the unpleasant sensation of wetness by the water absorption from bead-shaped super absorbent polymers, but has a cool sensation from the slow evaporation depending on the surrounding temperature, therefore this has resulted in the effect of enabling playing with stuffed toys not previously suitable for playing in the water.

Fourth, stuffed toys in the present design can minimize the breeding of bacteria/diffusing odor in use in water by introducing deodorant and/or disinfectant, and can be used as a deodorant indoors or in a car.

Fifth, when stuffed toys in the present design are defrosted in normal temperature after being frozen, condensation does not occur but they defrost slowly, therefore maintenance of a temperature cool but not overly cold to the touch of these stuffed toys can be achieved for a long period so stuffed toys are not only to be used as a cooling object but can even be used as a cold pack as well as a device to lower body temperature.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
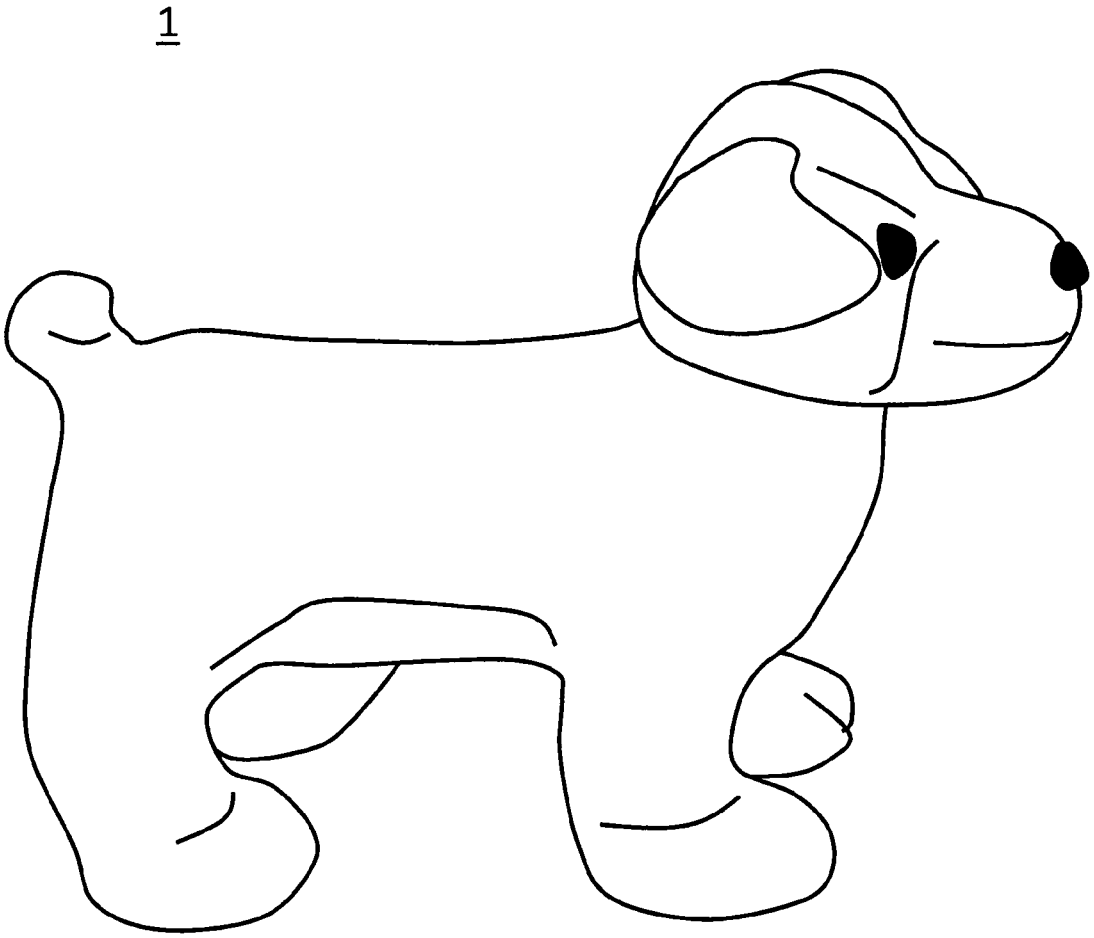
FIG. 1 is an illustration of a stuffed toy dog according to the present design.
Figure 2:
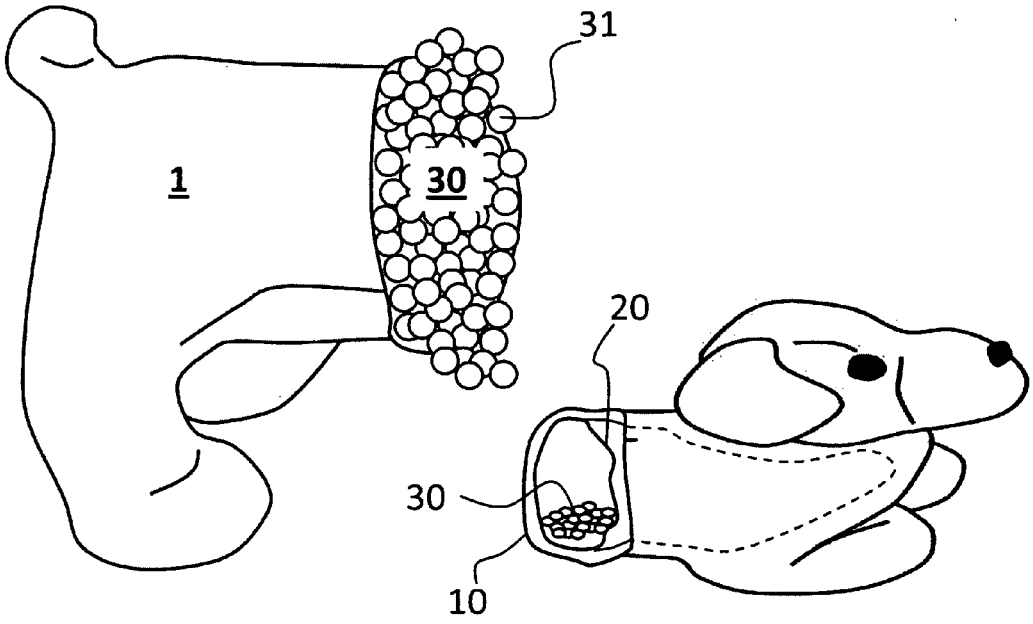
FIG. 2 is a longitudinal section illustration of a sample stuffed toy with before and after expansion of a bead-shaped super absorbent polymer, with the illustration on the right representing the super absorbent polymer in the before expansion position and the picture on the left representing the super absorbent polymer in the after expansion position.
Figure 3:
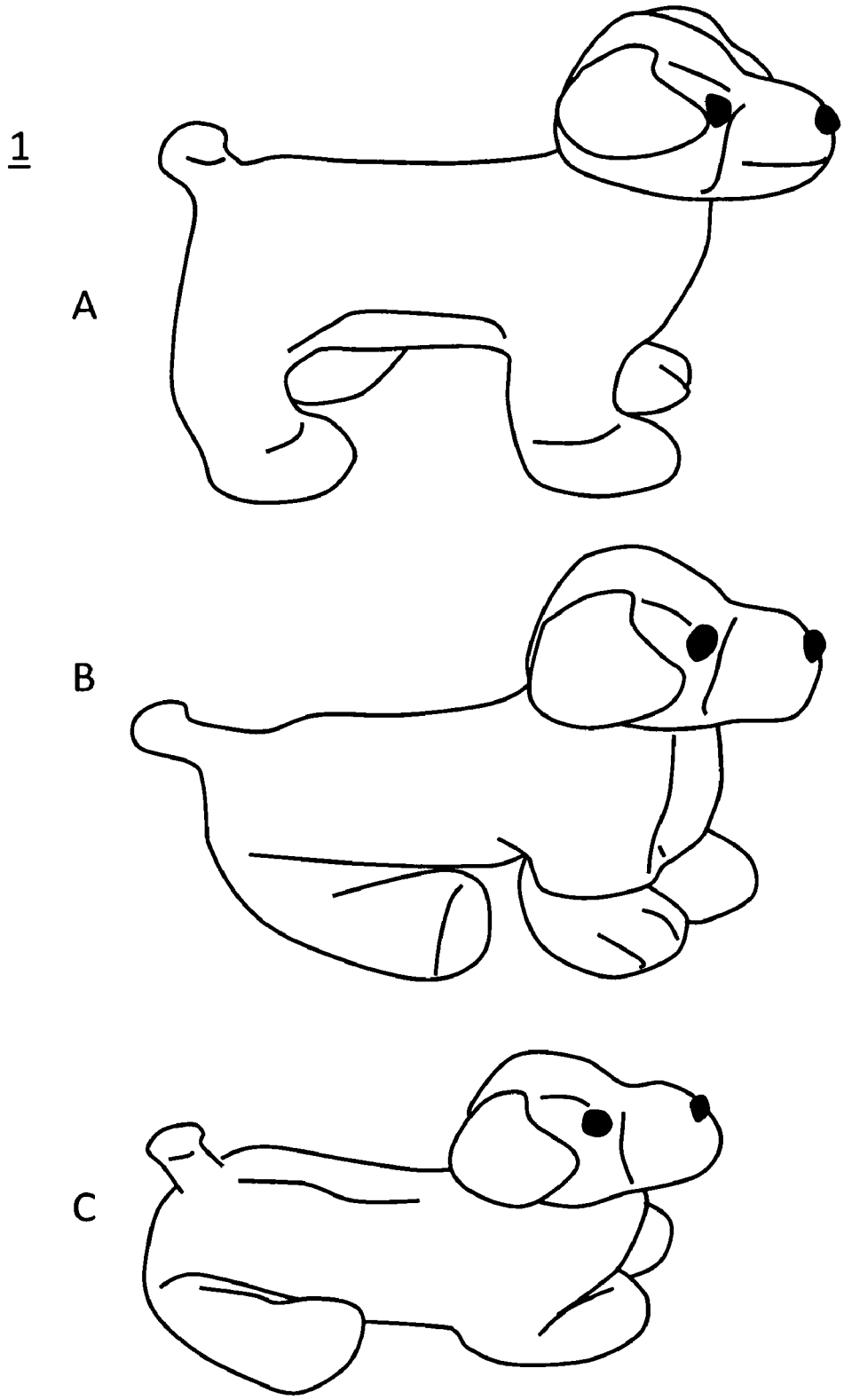
FIG. 3 is an illustration of a sample stuffed toy in stages of expansion and contraction according to the present invention.

The present invention relates to stuffed toys and, more specifically, to stuffed toys formed in the shapes of various dolls or animals that are filled with a bead-shaped super absorbent polymer having variable states of contraction and expansion according to liquid absorption, without the leakage of the super absorbent polymer itself. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As shown in FIGS. 1 through 4, the stuffed toys filled with super absorbent polymer in the present design (1) are formed by sewing up fabric (cloth) of the inner space and filling this space with filler in making the shapes of dolls and animals. According to the characteristics of the present design, the fabric is not of single material, as in the prior art compositions, but comprises two different outer (10) and inner fabrics (20) to specification.

The outer fabric (10) needs to be made of water penetrable fabrics typical of those being used in stuffed toys, non-limiting examples of such fabrics include Velboa and EF Velboa, Micro fiber Filament.

The inner fabric (20) is filled inside the outer fabric (10) and is formed of water penetrable material. Additionally, the outer fabric (10) is a high-density, bead-proof fabric for the beads (31) in the bead-shaped super absorbent polymer (30).

As a inner fabric (20), any bead (31) resistant material for the bead-shaped super absorbent polymer (30) can be used, a non-limiting example of which includes a high-density fabric such as T/C(POLYESTER/RAYON).

More specifically, for inner fabrics the thread count with a minimum of 20×20 (threads per inch) to a maximum of 60×60 (threads per inch) and the density of a minimum 108×58 to a maximum 140×120, such as T/C, can be used. When the thread count exceeds said scope or the density is too high, the water penetration will take too long for the desired effect and if the density is lower than said scope, the leakage of beads (31) will occur.

Fabrics used in stuffed toys in the present design (1) will comprise two different materials of outer fabric (10) and inner fabric (20), and the outer fabric (10) will be made of water penetrable material and the inner fabric (20) will be both water penetrable and bead-proof for the purpose of maintaining the softness on the surface in the outer fabric while allowing the water to penetrate between the outer fabric (10) and the inner fabric (20). For the purpose of preventing leakage of beads (31) in the bead-shaped super absorbent polymers (30), a high-density material is used for the inner fabric (20).

For the same purpose, when the desired shapes are stitched (sewn) on the outer fabric (10) and the inner fabric (20), stitches are made with finer density than typical stuffed toys in order to prevent bead-shaped super absorbent polymer (30) from leaking between the stitches (2) of the inner fabric (20). As an example, the stitching applied in the present design is preferably 7 to 20 stitches per inch, and approximately 15 stitches per inch is desired. Although stitching up to 20 stitches may be possible in some machines, too many stitches per inch can be taxing on sewing machines and may actually have negative effects on leak prevention, so the standard leak prevention level in bead-shaped super absorbent polymer (30) is sufficient.

The inner space (S) of the present design formed by the inner fabric (20) and is filled with a super absorbent polymer (30), a non-limiting example of which includes a sodium acrylate polymer. Super absorbent polymers are macromolecules that are characterized as not easily releasing water after absorbing tens to hundreds of times its own weight and after having pressure applied to some measure. For example, such polymers are widely used in hygienic products including paper diapers, menstrual pads and breast feeding pads that require absorption of liquids.

Generally, super absorbent polymers are polymerized with hydro monomers such as —OH, —NH2, —COOH, —SO3H, with cross-linkers to form networks of three-dimensional composition. For hydro monomers, partially neutralized acrylic acid is used. For composition methods of bulk polymerization, solution polymerization, inverse suspension and inverse emulsion, polymerization methods are known to be used.

To manufacture super absorbent polymers with specific forms of particles, inverse suspension and inverse emulsion polymerization methods are applied. For example, the inverse suspension polymerization method that polymerizes receptive monomers by breaking down with solution is known to be a desirable method for manufacturing super absorbent polymers.

The particle forms of super absorbent polymers that have been expanded by absorbing liquid are widely varied. For example, the super absorbent polymer that is formless when expanded can leak from the inner space (S) and from the inner fabric (20) and outer fabric (10) through the stitching (2). Therefore, a formless super absorbent polymer is not suitable for application in stuffed toys of the present design.

Figure 5:
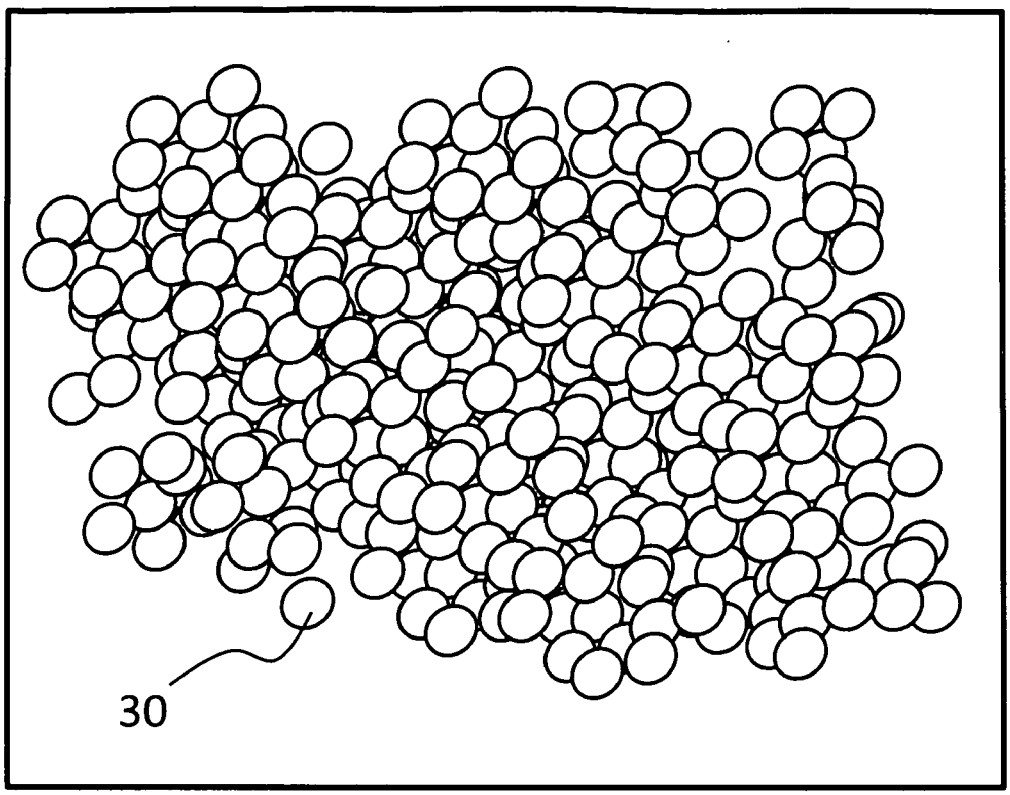
FIG. 5 is an illustration of particles suitable for the bead-shaped super absorbent polymer in the present design and a typical super absorbent polymer.
Figure 5:
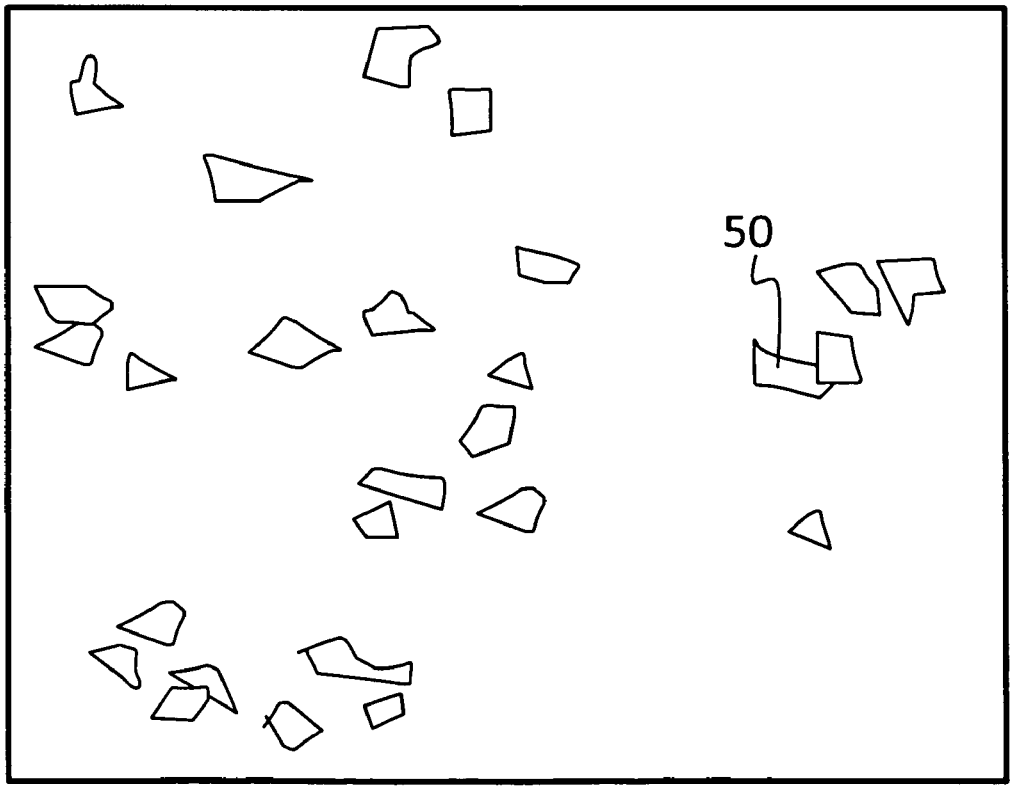

Accordingly, bead-shaped (e.g., pearl-shaped, sphere-shaped, and oval-shaped, etc.) super absorbent polymers (30) are used in the stuffed toys in the present design. For further understanding, FIG. 5 is an illustration depicting the particles of a bead-shaped super absorbent polymer (30) and a typical super absorbent polymer (50). Only the bead-shaped super absorbent polymers (30) can be applied in the present design, while the shapeless (typical) super absorbent polymer (50) can result in leakage and therefore is not suitable for the present design.

Super absorbent polymers (30) in the present design cannot penetrate between the inner fabric (20) and the stitching (2) when expanded after absorbing liquid. Even if a small amount penetrated, it would be an extremely small amount.

Of course, the polymers (30) that have not absorbed water are in the form of powder (the diameters of the beads are very small). Polymers (30) that have absorbed water but in an insufficient amount (the diameters of the beads are still small) remain unexpanded such that even if they penetrate between the stitching and the inner space (20), the bead-shaped super absorbent polymers in powder form or small diameters exist in small capacity in the inner space (S) capacity, so, in reality, there is no leakage since no pressure is placed on the inner space (20).

The diameter of the expanded beads (31) in the super absorbent polymers (30) can be selected accordingly to the density of the inner fabric (20). For example, the higher density the inner fabric (20) has, the diameters of beads (31) can be relatively smaller; and the lower density the inner fabric (20) has, there is a need for using beads (31) with larger diameters.

It is desirable to have beads of larger diameters in the bead-shaped super absorbent polymers (30) to avoid leakage, a non-limiting example of which includes having beads (31) with an average diameter of 0.1-1.0 millimeters.

As described above, the bead-shaped super absorbent polymers (30) expand by tens and hundreds when water is absorbed, so it is not desirable to use too much filler (i.e., bead-shaped super absorbent polymers (30)) in the inner space (S) to avoid excessive expansion and increased pressure on the fabric (10, 20). Such excessive expansion and increased pressure may result in leakage of beads or breakage of stitches to occur. Also, it is not desirable to use too small an amount of polymer (30) as filler, since the original shape of the stuffed toy (1) will not be formed.

According to the test conducted by designer of the present design, although there was some variation depending on the absorption rate (expansion rate) of the bead-shaped super absorbent polymers, approximately 1.2% to 10% of the water weight of the absorbed water in the inner space (S) was appropriate. However, the appropriate amount of filler is best controlled according to the absorption rate of the applied bead-shaped super absorbent polymers (30) and according to the absorption amount, within the scope to avoid over-expansion of the stuffed toys in the present design.

The bead-shaped super absorbent polymers can be manufactured according to the method described in Korean Patent number 0492917 and can also be purchased commercially. For example, sodium acrylate polymer (e.g., sodium polyacrylate) with a molecular formula of $(C_3H_4O_2)\times XNa$ has a bulk density of approximately 0.9±0.1 (g/ml) and is non-toxic and non-odorous in solution and to the touch. The sodium acrylate polymer absorbs about 84 times the water to expand into bead-shapes and is considered desirable for the present application.

Figure 4:
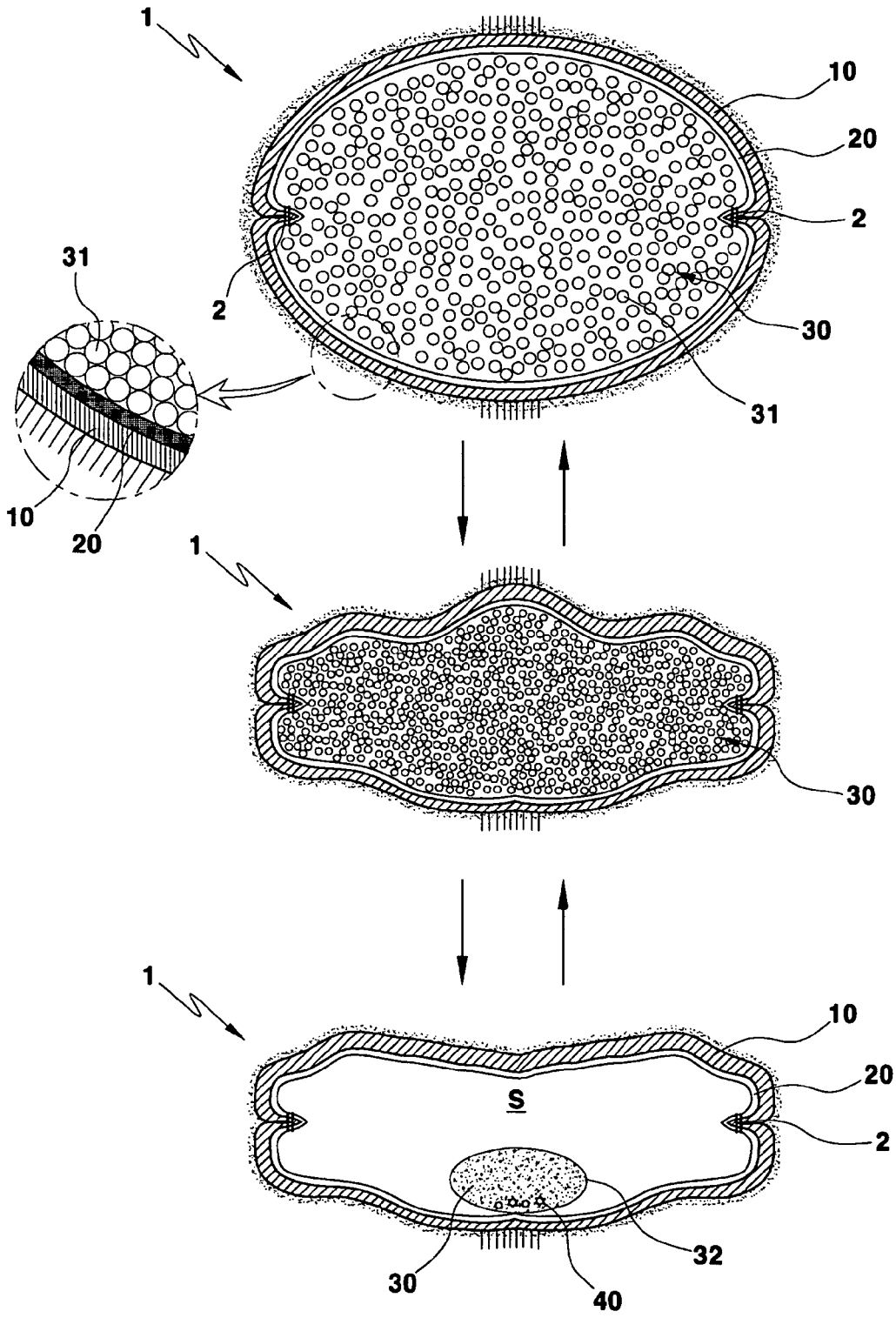
FIG. 4 is a longitudinal section illustration of the stuffed toy before and after expansion according to the present invention.

The stuffed toys in the present design (1) are for use in the water and therefore can promote fungus growth and become odorous. As shown in FIG. 4, in order to avoid odor, an appropriate amount (typically minute in amount) of one of the additives (40) can be added. There is no specific limitation to the kind of additives (40) to be added among widely used deodorant or disinfectant, unless harmful to the human body. Additionally, the odor can be removed by simple washing with agents such as soaps.

Bead-shaped super absorbent polymers (30) can be inserted directly into the inner space (S) created by the fabric (10, 20) or inserted in capsules (32) that are separately formed. These capsules can be made from a water soluble material or easily dissolvable by depressing materials.

When capsules are used (32), the capacity of the capsule (32) can be adjusted to the capacity of super absorbent polymer (32) to match the appropriate amount (in fixed amounts) for stuffing of the toys in the present design according to the size of the stuffed toys (1). There is an advantage of not having the bead-shaped super absorbent polymers (30) as fluid in the inner space (S) during distribution of stuffed toys (1). Once the stuffed toys absorb water, the capsule (32) is dissolved or broken.

Stuffed toys according to the present invention have enabled use of super absorbent polymers as a filler that was not imaginable prior to the design in the form of powder before absorbing water and the form of paste (or gel) after absorbing water. Additionally, the present invention improves upon the prior art by applying two different layers of fabric of water penetration outer fabric (10) and water penetration/bead-proof inner fabric (20) and by applying bead-shaped super absorbent polymer as a filler in stuffed toys.

The stuffed toys (1) according to the present invention can change the water absorption rate and evaporation rate in the filled bead-shaped super absorbent polymers (20), which enables the expression of various positions according to the absorption/evaporation rate to add enjoyment to play and at the same time enables playing in the water with stuffed toys that were not previously appropriate to play with in the water.

According to tests, the elapsed time between the almost dry state to the complete saturation of the super absorbent polymer (30) when the stuffed toy (1) shown in FIG. 3(C) was submerged in water was 1-3 minutes, and the evaporation of the completely expanded stuffed toy (illustrated in FIG. 3(A)) to complete contraction (again, illustrated in FIG. 3(C)) took a few hours to one week, depending on conditions.

Stuffed toys (1) in the present design use fabric made up of cloth (10, 20) such that when they are applied to water, the wetness of the fabric may be expected to feel unpleasant; in actuality, the super absorbent polymer (30) absorbs most of the water so the stuffed toys do not feel unpleasant and in fact feel cool to the touch as the endothermic evaporation occurs slowly from the water absorbed in the super absorbent polymer (30).

Also, when the expanded stuffed toy from absorbing water is frozen and then defrosted, there is no condensation due to the outer fabric (10) and the inner fabric (20) insulating temperatures so that defrosting takes place slowly, maintaining the cool sensation without an overly cold sensation being present when touching the stuffed toy. Therefore, the stuffed toys in the present design can be used not only for a cooling effect but also as a cold pack and for decreasing body temperature.

In another aspect, when an appropriate amount of additive (40) of deodorant and/or disinfectant is introduced to the stuffed toys (1) in the super absorbent polymer (30) as a filler, breeding of bacteria/diffusing odor is disrupted so that the stuffed toys (1) can be used as a deodorant indoors or in a car.

Also, when the stuffed toys (1) in the present design are provided to a consumer, the absorbable amount of water (maximum absorption rate, median absorption rate, etc.) may be indicated on the labels for the consumer's reference.

What is claimed is:

1. A stuffed toy filled with super absorbent polymer, comprising:

a water permeable outer fabric being stitched in a shape according to the stuffed toy;

a water permeable inner fabric positioned inside the outer fabric and stitched to form a inner space; and a bead-shaped super absorbent polymer positioned in the inner space with a sufficient volume such that when water is absorbed by the bead-shaped super absorbent polymer, the bead-shaped super absorbent polymer expands to fill the inner fabric, which in turn fills the outer fabric to cause the outer fabric to form into the shape according to the stuffed toy; and wherein the inner space has a water weight capacity and the bead-shaped super absorbent polymer fills between 1.2% and 10.0% of the water weight capacity in the inner space.

2. The stuffed toy as set forth in claim 1, wherein at least the inner fabric is a bead-proof fabric having a density to prevent beads with a diameter of between 0.1 millimeters and 1.0 millimeter from penetrating the inner fabric.

3. The stuffed toy as set forth in claim 2, wherein the stitching of the inner fabric includes between seven and twenty stitches per inch to prevent leakage of the bead-shaped super absorbent polymer through the stitching.

4. The stuffed toy as set forth in claim 3, wherein the stuffed toy filled with super absorbent polymer is characterized by having an additive introduced in the inner space, the additive being selected from a group consisting of deodorant and disinfectant.

5. The stuffed toy as set forth in claim 4, wherein the stuffed toy filled with super absorbent polymer is characterized by the super absorbent polymers being filled with capsules that are easily dissolved in water.

6. The stuffed toy as set forth in claim 1, wherein the stitching of the inner fabric includes between seven and twenty stitches per inch to prevent leakage of the bead-shaped super absorbent polymer through the stitching.

7. The stuffed toy as set forth in claim 1, wherein the stuffed toy filled with super absorbent polymer is characterized by having an additive introduced in the inner space, the additive being selected from a group consisting of deodorant and disinfectant.

8. The stuffed toy as set forth in claim 1, wherein the stuffed toy filled with super absorbent polymer is characterized by the super absorbent polymers being filled with capsules that are easily dissolved in water.

* * * * *